US005782049A

United States Patent [19]

Gates et al.

[11] Patent Number: 5,782,049

[45] Date of Patent: Jul. 21, 1998

[54] TWO-PART COLLAPSIBLE CORRUGATED PAPER FORM VOID

[75] Inventors: Robert C. Gates, Lakewood; Michael L. Turner, Englewood, both of Colo.

[73] Assignee: Surevoid Products, Inc., Englewood, Colo.

[21] Appl. No.: 763,408

[22] Filed: Dec. 11, 1996

[51] Int. Cl.[6] ..... E04B 5/00

[52] U.S. Cl. ..... 52/323; 52/577; 249/10

[58] Field of Search ..... 52/323, 745.09, 52/745.12, 576, 577; 249/10; 428/182

[56] References Cited

U.S. PATENT DOCUMENTS 3,834,103 9/1974 Knohl ..... 52/576 X 5,498,451 3/1996 Lafond ..... 428/182 X

*Primary Examiner*—Creighton Smith

*Attorney, Agent, or Firm*—Richard W. Hanes

[57] ABSTRACT

A two-part collapsible form void for providing a space between a poured concrete structure and an underlying expansive soil is formed of a foldable outer section and a foldable inner section which, when erected, is longitudinally slidable into the erected outer section. The form void may be shipped in the separated and collapsed state, reducing shipping volume by up to 85 percent, and is easily erected by hand at the job site.

16 Claims, 6 Drawing Sheets

TWO-PART COLLAPSIBLE CORRUGATED PAPER FORM VOID

BACKGROUND OF THE INVENTION

This invention relates generally to the construction of concrete walls, slabs or other structures adjacent to or inclusive of spaces. More particularly, this invention pertains to void forms for creating spaces beneath concrete structures to separate and protect the structures from underlying expansive soils.

Expansive soils are prevalent in many areas of the United States, as well as in other countries. Such soils typically contain much clay, and expand and contract considerably as a result of cyclical changes in moisture content and/or as a result of natural freezing-thawing cycles.

A common method of construction in such expansive soils uses spaced drilled piers or spread footings for supporting the walls and floors. In this method, the concrete walls or beams supported by the piers or footings must be provided with a substantial vertical spacing from the underlying expansive soils. Otherwise, upward expansion of the soil may contact and force the beams or walls upward, causing cracking and deformation of the concrete. Without the required spacing, the integrity of the concrete structure is eventually lost.

Excavation of soil from beneath a concrete structure after it has "set" is a labor-intensive, very expensive method for resolving the problem with expansive soils. Where the structure has a lower edge below grade, a trench sufficiently wide to permit hand removal of soil below the structure must be provided. Furthermore, it is desirable to remove any forms of wood, metal or plastic used to form the lower surface of the structure. Such forms have a long life and should be removed after the concrete has set to provide further expansion space below the structure, and for re-use.

The use of integral corrugated paper form voids is known. In one application, such form voids are placed at the bottom of wall forms and trenches to separate the subsequently poured concrete from the ground. The corrugated paper form voids have sufficient temporary strength to support the wet concrete at a distance above the ground, but gradually absorb water and deteriorate to a condition where they no longer provide support. However, by this time the concrete has set and needs no support other than that provided by the piers. During periods of upward expansion of the underlying soil, the soil occupies the space left by the deteriorated or weakened form voids.

Form voids are available in various cross-sectional configurations. The generally rigid voids are prepared by forming the desired structural shape of panels of corrugated paper and joining the panels together with adhesive. An internal cellular grid structure may be used within the form void to increase the strength of the form void as required. The exterior surfaces of the paper form voids are typically treated with wax to provide temporary water resistance and thus an appropriate time delay in deterioration.

Shipping charges are a major cost of using such form voids. Existing paper form voids are lightweight, their cross-sections being typically about 70–90 percent space. Thus, the quantity of paper form voids which may be fitted into a truck is severely limited, and the weight of the truckload is only a small fraction of the available weight limit for the truck.

It is an object of the invention to provide a form void which will occupy much less space in a truck without sacrificing void size. Thus, the shipping cost may be greatly reduced.

BRIEF SUMMARY OF THE INVENTION

An improved trapezoidal form void is fabricated from corrugated paper and has a two-part structure permitting complete separation of the two parts. An inner part is expanded and longitudinally inserted by sliding into an expanded outer part. Each of the parts may be separately folded and collapsed to a generally flat sheet of several panels thickness for shipping and storage. Each of the panels of the inner and outer parts is comprised of one or more plies of corrugated paper. The two-part form void may be formed in any convenient length appropriate to the end use, and is readily cut to length at the construction site with a saw or knife.

The paper from which the form void is manufactured is like that from which paper cartons are typically formed, i.e. a corrugated paper structure sandwiched and cemented between two sheets of thin corrugated paper. The corrugated paper has greater strength in the direction of the corrugation ridges than across the ridges, hence a corrugation ridge direction is maintained parallel to the direction of applied compressive forces to increase the weight of wet concrete which may be supported. Though the two-part form void is easily assembled and disassembled, it maintains a high strength for temporary support of a high load of wet concrete. The corrugated paper as used in the manufacture of the form void described herein is readily obtainable from numerous sources.

The form void is assembled and disassembled easily by hand, without machinery, and does not need on-site application of adhesive. In the disassembled or collapsed configuration, the two parts of the form void may be stacked or bundled to enable shipment at a much higher density. The shipping costs are substantially reduced when compared to the one-part non-collapsible form voids of the same size.

These and other objects and advantages of the invention will be readily understood by perusal of the following description in conjunction with study of the accompanying figures of the drawings wherein like reference numerals have been applied to designate like elements throughout the several views.

DESCRIPTION OF THE PREFERRED EMBODIMENTS

Figure 1:
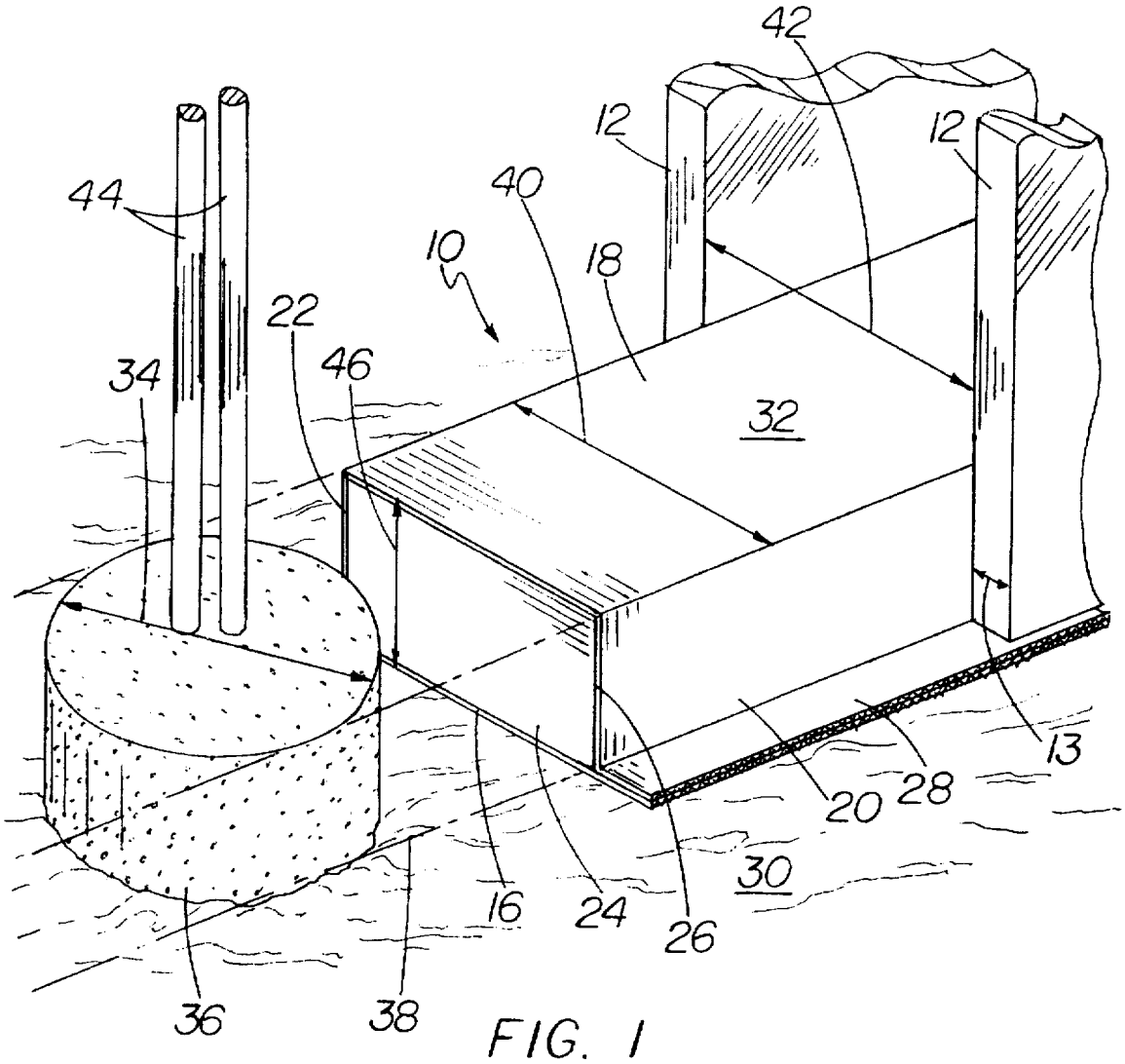
FIG. 1 is a perspective partial side view of a form void of the invention in place for forming a concrete beam supported on piers.

With reference to the drawings, and particularly to FIG. 1, a collapsible two-part corrugated paper form void 10 is shown as used in conjunction with vertical concrete forms 12 for making a concrete structure 14, e.g. a beam (see FIG. 2) to be supported by piers 36. The elongate form void 10 has a generally rectangular cross-sectional shape whose outer part 52 includes a base panel 16, upper panel 18 parallel to base panel 16, and parallel first and second side panels 20, 22, respectively. End caps 24 may be used to seal the otherwise open ends 26 of the form void 10. The form void 10 may include a bottom flange 28 approximately co-planar with base panel 16, for more easily maintaining the position of the form void between the forms 12. Only small portions of the forms 12 are visible in FIG. 1, and a pier 36 is shown with reinforcing rods 44 for structurally tying the beam 14 to the pier.

In the exemplary use illustrated, one or more units of the form void 10 are placed end to end on the ground 30 or other surface with the planar top surface(s) 32 of the upper panel(s) 18 at an elevation corresponding to the desired bottom surface elevation of the concrete beam 14. The form void 10 is shown as being placed between spaced drilled piers 36 which will ultimately support the hardened concrete beam 14. Any space 38 between the form void 10 and the piers 36 is preferably filled with an appropriate disintegratable material such as a form void conformable to the piers. Such is not the subject of this application.

In this discussion, the term "length" refers to the dimension corresponding to the long dimension of the assembled form void 10. Likewise, the term "width" refers to the dimension corresponding to the width of the assembled form void 10.

The top surface 32 of the upper panel 18 of the form void 10 has a width 40 generally equivalent to the desired width 42 of the beam 14 to be formed. The bottom flange or flanges 28 are approximately coplanar with base panel 16 and each flange extends outwardly from a side panel 20 or 22 for stability on the ground 30. A form 12 may rest on a bottom flange 28, and in any case both forms 12 must be in sufficient contact with the first or second side panel 20, 22 to generally prevent passage of wet concrete between the form 12 and side panel. In FIG. 1, forms 12 are supportably placed against side panels 20, 22 of the form void 10, one of the forms 12 resting on the single bottom flange 28 to hold the form void 10 in place. The height 46 of the form void 10 is the minimum upward distance available for soil expansion beneath the structure 14.

The width 40 of the form void 10 does not have to be equal to the pier diameter 34. In many cases, the beam or wall 14 to be resting on piers 36 has a width 42 less than the pier diameter 34. Alternatively, the beam width 42 may exceed the pier diameter 34. The form void 10 may be made in any useful width, or multiple units of form voids 10 may be placed side by side to equal the desired width.

Figure 2:
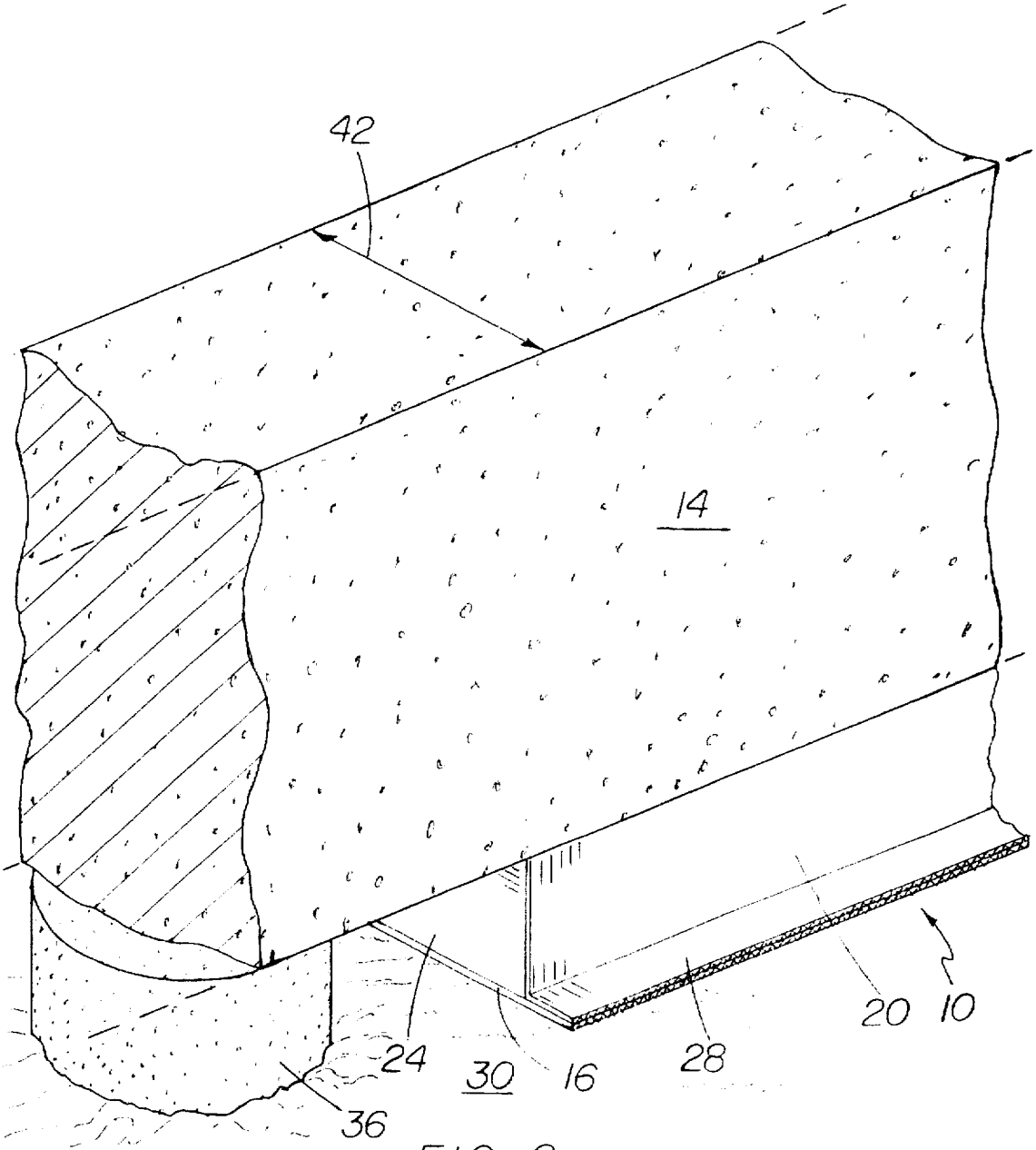
FIG. 2 is a perspective partial side view of a form void of the invention underlying a portion of a concrete beam after the beam has been poured and set, and the forms removed.

The form void 10 is manufactured with sufficient initial strength to support the wet concrete poured between the forms 12, and weakens and disintegrates in time upon passage of ground moisture and moisture from the wet concrete into the paper fibers. When the concrete has set and forms 12 removed, as shown in FIG. 2, the beam 14 or other structure so formed is supported entirely by the piers 36. The form voids 10 rapidly deteriorate and disintegrate to a non-supportive state. The ground 30 (including expansive soils therein) underlying the beam 14 is spaced from the beam and may rise upwardly toward the beam without contacting it or exerting a high force thereon. Thus, the common destructive effects of expanding soils on concrete structures may be avoided.

Figure 3:
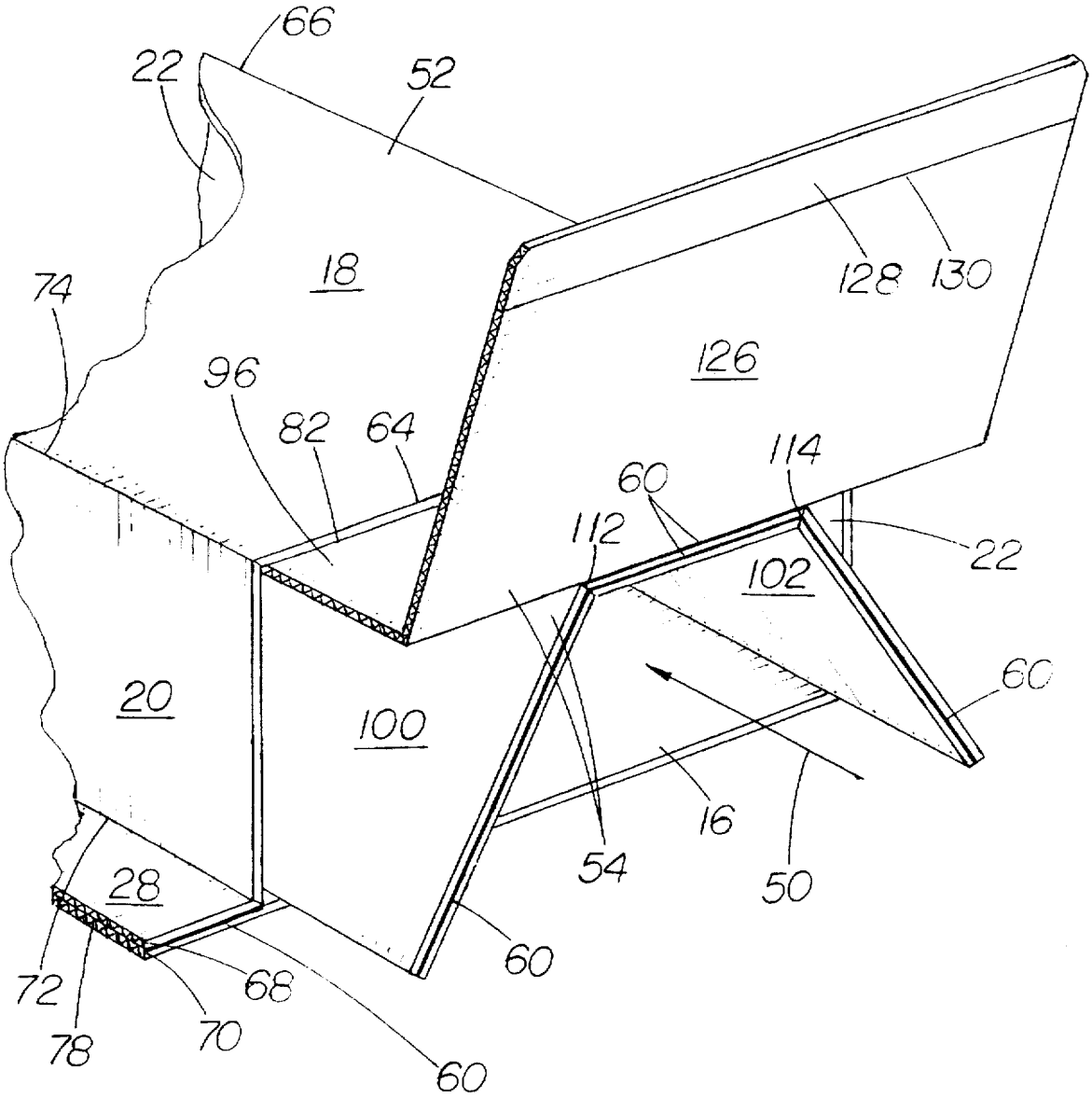
FIG. 3 is a partial perspective end view of a form void of the invention undergoing assembly.

As shown in FIG. 3, the form void 10 is comprised of separate outer part 52 and inner part 54, which are joined simply by unfolding of both parts and longitudinal sliding in direction 50 of the inner part into the outer part. It is preferred that the inner part 54 fit snugly into the outer part 52 without providing excessive resistance to sliding the parts together.

Each of the outer part 52 and inner part 54 is formed by making longitudinal fold lines in corrugated paper sheets to produce panels therebetween, and joining some of the panels in specific areas with adhesive 60. Once formed, the two parts 52, 54 are easily erected and joined by hand, and no further application of adhesive 60 is required to complete the form void 10. The opposed base panel 16 and upper panel 18 are of equal width, and the opposed side panels 20, 22 are of equal width. Together, these panels 16, 18, 20 and 22 form a rectanglar parallelogram in cross-section. When erected, the inner part 54 becomes an articulated structure generally extending to each "corner" of the outer part, i.e. proximate the fold lines defining the upper and base panels 18, 16, respectively.

Figures 4, 5:
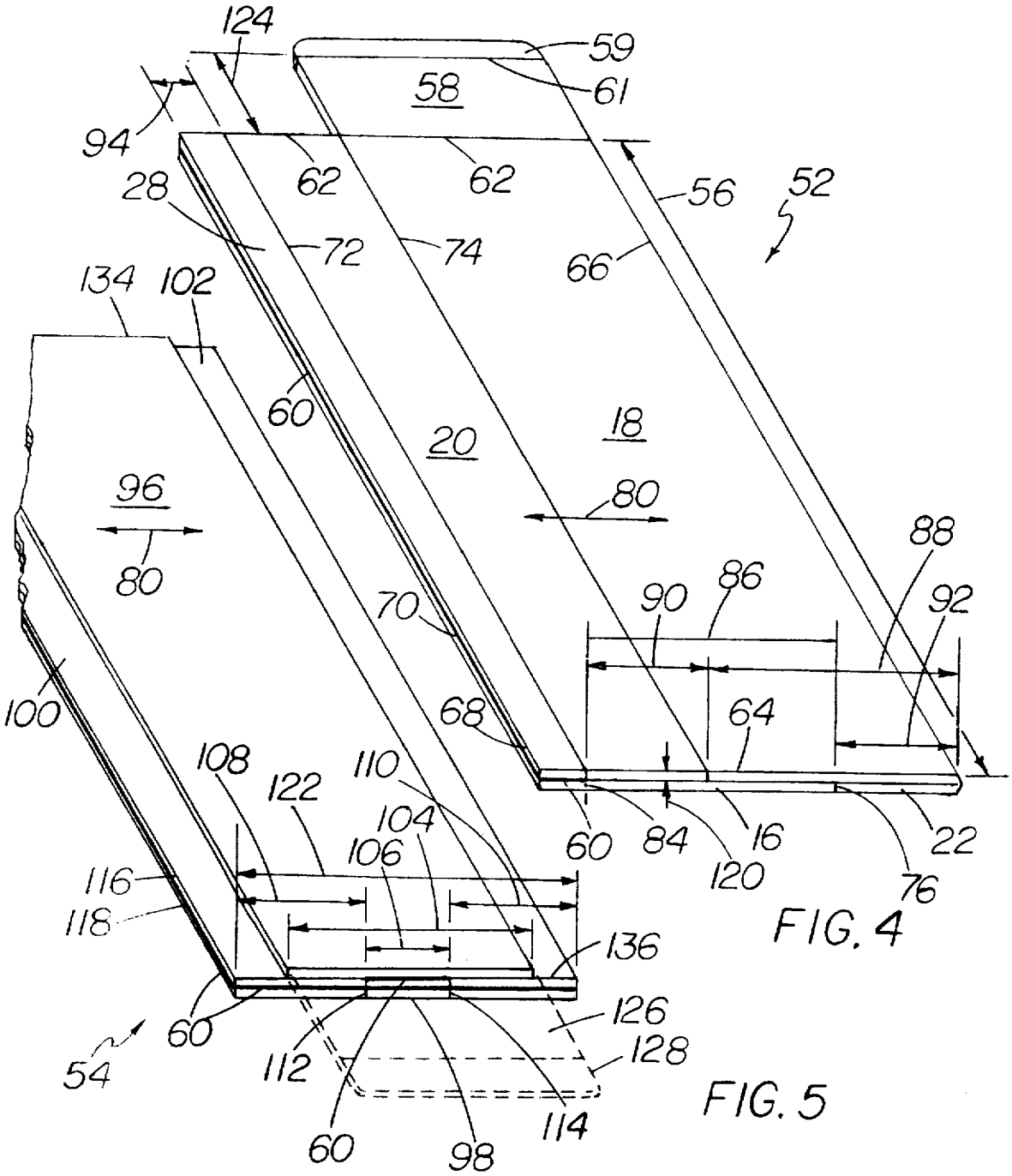
FIG. 4 is a perspective top view of a compressed outer part of a form void of the invention with exaggerated panel thicknesses.
FIG. 5 is a perspective partial top view of a compressed inner part of a form void of the invention with exaggerated panel thicknesses.

Looking now at FIGS. 3 and 4, we see the latter showing an outer part 52 in a folded or "knock-down" state conducive to shipping. The outer part 52 is formed of a single sheet of corrugated paper having length 56, although inclusion of an end cap 58 (having a fold-in tab 59 with fold line 61) at a first end 62 and/or the second end 64 of the outer part 52 will increase the overall unerected length for shipping.

The corrugation ribs or ridges 78 of the outer part panels are preferably oriented as extending vertically or in direction 80 across the form void 10, i.e. both at 90 degrees with the longitudinal direction, in order to provide the greatest strength in the direction of downwardly applied forces.

The outer part 52 is formed by first folding the sheet along center fold line 66 and joining the first side edge 68 to the second side edge 70 with adhesive 60. The portions joined by adhesive 60 comprise a bottom flange 28. Side panel 20 is formed by folding upward about flange fold line 72. Third fold line 74 is made to separate side panel 20 from upper panel 18. Likewise, fourth fold line 76 is made to separate side panel 22 from base panel 16. Base panel 16 is delineated by fold line 76 and a line 84 congruent with flange fold line 72. Line 84 is not intended to be a fold juncture. Fold lines 66, 72, 74 and 76 are all parallel and extend longitudinally between first end 62 and second end 64. When erected, the interior 82 of the erected outer part 52 forms a rectangular parallelogram. Thus, the width 86 of base panel 16 and the width 88 of the opposed upper panel 18 are equivalent, and the width 90 of first side panel 20 is equivalent to the width 92 of the opposed second side panel 22.

The width 94 of bottom flange or flanges 28 is sufficient for a standard form 12 to hold the form void 10 in place. The form 12 may have a thickness 13 (FIG. 1) either greater than, equal to, or less than the width 94.

In FIG. 5, an inner part 54 is shown in a non-erected condition, as manufactured. As shown in FIGS. 3 and 5, the inner part 54 is comprised of four panels formed from two or more sheets of corrugated paper.

The corrugation ribs or ridges 78 of the inner part panels are preferably oriented as extending vertically or in direction 80 across the form void 10, i.e. both at 90 degrees with the longitudinal direction, in order to provide the greatest strength in the direction of downwardly applied forces.

The inner part 54 includes a top panel 96, a middle panel 98, and first and second strut panels 100, 102. The top panel 96 has a width 104 which is generally less than the width 88 of panel 18 by about two times the thickness 120 of the corrugated paper of panel 18. The middle panel 98 and two strut panels 100, 102 adjoined thereto are formed from one or more coextensive plies or layers of corrugated paper. FIG. 5 shows two layers 116, 118 of width 122 which are joined together by adhesive 60 to form panels 98, 100 and 102 separated by fold lines 112 and 114. The overall strength, i.e. crush resistance of the assembled form void 10 may be varied by using multiple layers of corrugated paper in some or all panels. In addition, the use of corrugated paper with greater or lesser thickness 120 will vary the strength of the form void 10. Thus, the form void 10 may be selectively produced in any particular strength over a wide range of useful strengths.

Middle panel 98 is joined to the top panel 96 with adhesive 60. Strut panels 100, 102 may then be folded downward at fold lines 112, 114, respectively, and the inner part 54 longitudinally inserted into the erected outer part 52, as shown in FIG. 3.

The panels joined by adhesive 60 in this form void 10 have the greatest strength when the layer of applied adhesive 60 is continuous between those panels so joined. However, non-continuous e.g. spot application of adhesive may optionally be done, resulting in a slight loss in strength.

The adhesive 60 may be of any composition which will tightly bond the corrugated paper panels. Preferably, however, the adhesive 60 is biodegradable, as typified by adhesives with a starch base.

For most uses of the form void 10, it is important that little or no wet concrete be permitted to flow past the upper panel 18 and into the form void 10 itself. Such would defeat the purpose of the form void 10. An end cap may be provided at one or both ends of the form void 10 and may be configured in several ways. First, as illustrated in FIG. 4, end cap 58 is an extension of upper panel 18 and has a height dimension 124 appropriate for tucking fold-in tab 59 into the lower portion of the outer part 52.

In another embodiment illustrated in FIGS. 3 and 5, each end cap 126 is formed as an extension of top panel 96 of the inner part 54, and includes a fold-in tab 128 having fold line 130.

In a third embodiment, not illustrated, a piece of paper stock such as corrugated paper is simply cut to the cross-sectional shape of the form void 10 and cemented to the end thereof. However, this method requires application of adhesive 60 at the job site.

It should be noted that a more cohesive form void structure may be erected at a job site by joining adjacent outer parts 52 with a single inner part 54. Thus, separate portions of the inner part 54 are inserted into each of several outer parts 52. In this way, adjacent outer parts 52 are joined end to end and the need for end caps is reduced. Where the form void immediately adjacent the pier 36 is configured to receive an inner part 54, use of end caps may be avoided altogether.

Figure 6:
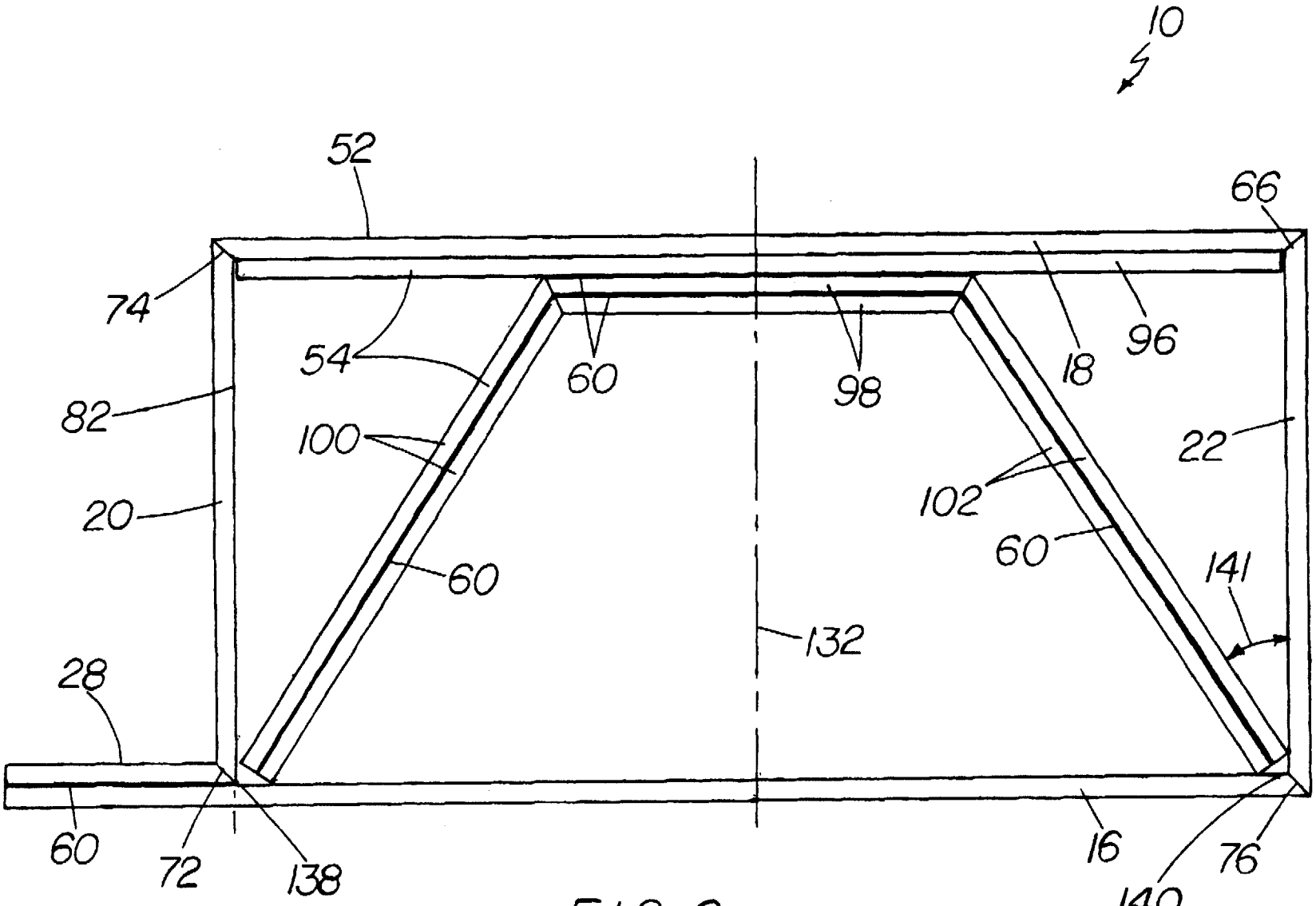
FIG. 6 is an end view of a form void of the invention.

Looking now at FIG. 6, a cross-section of an erected form void 10 is shown having a rectangular parallelogram interior 82 within outer part 52, and an erected inner part 54 extending generally to each corner corresponding to one of the fold lines 66, 72, 74, and 76. The inner part 54 is shown as being symmetrical about central longitudinal vertical plane 132.

Top panel 96 extends across the form void 10 below the upper panel 18 and is held rigidly between side panels 20 and 22. Strut panels 100 and 102 comprise internal supports extending angularly from the top panel 96 to proximate opposing fold lines 72 and 76, respectively, at each side of base panel 16. Loads on the upper panel 18 are transmitted downwardly through panels 100, 102 to the corners 138 and 140 formed by fold lines 72 and 76, respectively. The inner part 54 is thus held relatively immobile within the outer part 52.

The angle 141 of internal strut panels 100 and 102 with the vertical is shown as about 35 degrees. The angle 141 is preferably less than about 60 degrees, and more preferably less than about 45 degrees.

Figure 7:
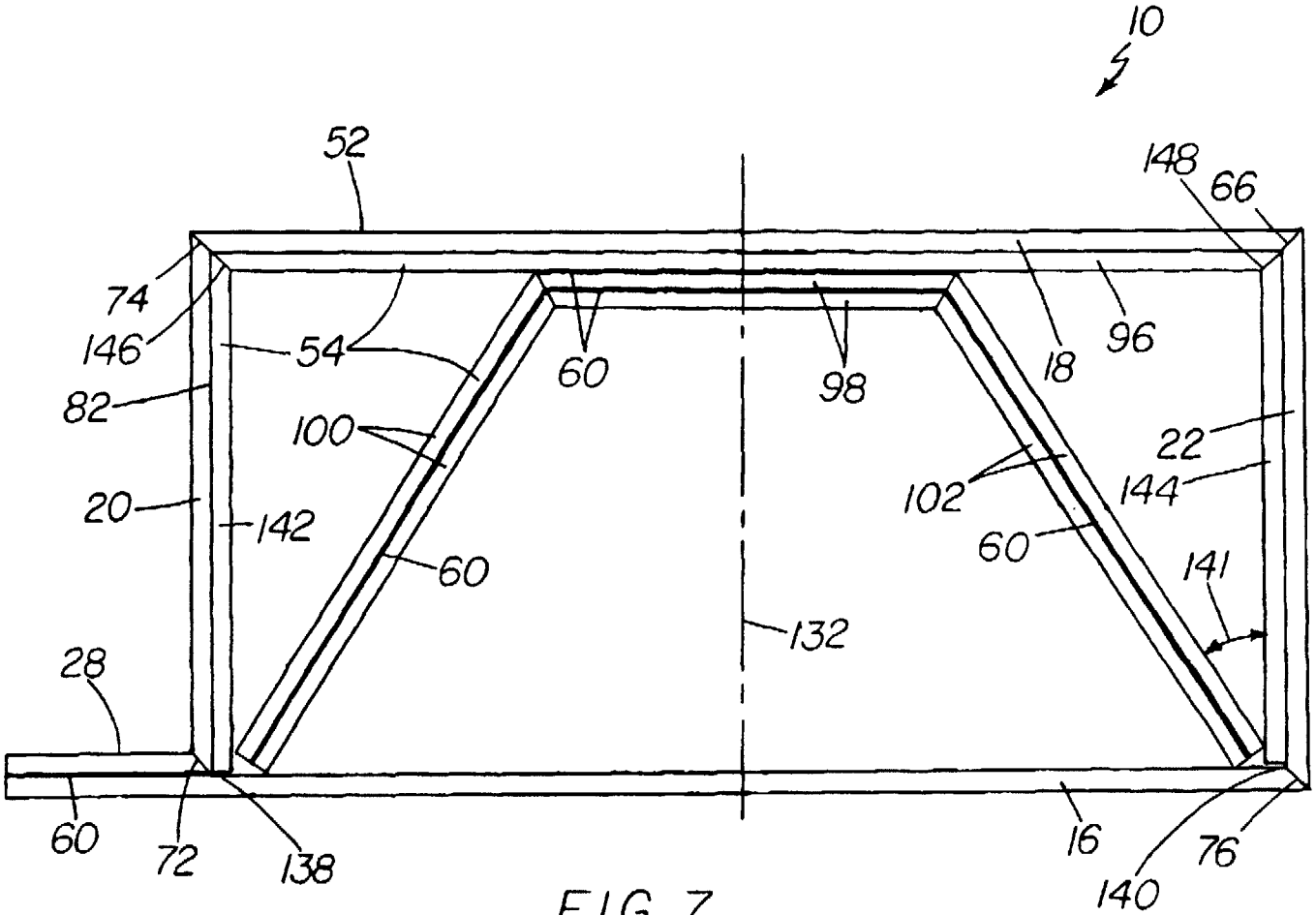
FIG. 7 is an end view of a further embodiment of a form void of the invention.

As shown in FIG. 7, a form void 10 of enhanced strength uses additional side support panels 142, 144 as part of the inner part 54. The sheet of corrugated paper from which top panel 96 is formed is thus of greater width and is folded about fold lines 146 and 148 to form side support panels 142, 144, respectively. These support panels 142, 144 provide additional strength for supporting loads on the upper panel 18 near fold lines 66 and 74.

As well known in the art, corrugated paper is constructed from an intermediate sheet of paper in which are formed multiple parallel reverse bends; the intermediate sheet is then cemented between parallel planar sheets of paper which form the opposing surfaces.

The opposing surfaces of the corrugated paper may have different inherent strengths due to differences in paper thickness or type of paper. These differences may be used to vary the overall strength of the form void 10. Where more than one ply or layer of corrugated paper is used to form a panel, the greatest strength results when the panel is configured to have the stronger paper surfaces exposed, i.e. on the exterior of the panel.

The size of the form void 10 will vary, depending upon the dimensions of the concrete structure 14 which is to be poured, and the desired spacing from the ground 30. Thus, for constructing a wall having a thickness of 6 inches (15.25 cm) with 4 inches (10.16 cm) of ground clearance, the width 88 of panel 18 will be about 6 inches and the width of panels 20 and 22 about 4 inches.

The length 56 of the completed form void 10 may vary, but the preferred length is such that an even number of voids will provide the desired distance between spaced-apart support piers 36. A form void length of 5 feet has been found in practice to be one of the most useful lengths, but other lengths may also be provided to accommodate variations in structural designs. Of course, the form void 10 may be easily cut on-site to any desired length with a knife or saw. When form voids 10 are placed end to end, the abutting ends may be sealed with a covering such as tape or a piece of paper to prevent the entrance of wet concrete. As already discussed, staggering the ends 134, 136 of the inner part 54 (FIG. 5) relative to the ends 62, 64 of the outer part 52 (FIG. 4) effectively prevents leakage of wet concrete into the form voids 10 where they adjoin. Versatility may be gained by the manufacture of outer parts 52 in a series of standard lengths, and inner parts 54 in lengths appropriate for each length of outer part as well as for joining outer parts of different lengths.

Although the form void 10 illustrated in FIGS. 1–7 has an inner part 54 which is symmetrical about vertical plane 132, non-symmetrical inner parts may be used. The resulting load-bearing strength will be asymmetrical across the width of the upper panel 18, and may be computed using known methods of static and dynamic analysis.

The exterior surfaces of the form void 10 are generally coated or impregnated with a water resistant material such as wax. As a result, an appropriate delay in disintegration and loss of strength of the form void 10 is achieved.

There are numerous ways to vary the strength of the form void 10. First, a corrugated paper panel of different thickness or design strength may be used. Secondly, one or more panels may be formed of more than a single ply of corrugated paper, the panel(s) thus being formed by cementing the plies or layers of corrugated paper material together with an adhesive 60. Third, interior side support panels 142, 144 may be added as adjoining top panel 96 to augment side panels 20 and 22. Fourth, as already mentioned, the adhesive may be applied in a continuous or non-continuous pattern. Fifth, the angle 141 of the strut panels 100, 102 may be varied. Sixth, an additional cellular structure of corrugated paper may be inserted within the form void 10 to enhance its strength, but such an addition generally negates the savings in shipping costs.

In the unassembled, i.e. "knocked-down" state, the form void 10 comprises an inner part 54 and an outer part 52, both having a generally flat configuration. The parts 52, 54 may be stacked wherein the panels comprise about 94 percent of the total space. By comparison, the panels comprise about 15 percent of the total space, after the form void 10 is erected. The net saving of space is nearly 85 percent. The number of form voids 10 which may be shipped in a given space is increased by a factor of about 6. Thus, the major object of the invention, i.e. a substantial savings in shipping costs, is realized. Where the form void 10 is reinforced through the use of additional plies of corrugated paper, or thicker paper, the shipping cost advantage may be slightly less.

Generally, no adhesive 60 is required for assembling the collapsible form void 10 at the construction site. The form void 10 may be quickly and easily erected by hand, merely by inserting the unfolded inner part 54 into the unfolded outer part 52 and sliding the inner part longitudinally therein. The form void 10 is easily cut to length with a saw or knife. Of course, there is no need to remove the form void 10 from its location below the poured concrete structure 14. The form void 10 disintegrates with time as it absorbs moisture and permits the underlying soil to expand without forcing the concrete structure 14 upward.

While the use of the form void 10 is particularly described relative to the construction of a concrete beam formed with vertical forms 12, it is understood that the form void 10 may also be used for constructing other types of concrete structures with spacing from underlying soils, or to produce spaces within the structures themselves.

It is anticipated that various changes and modifications may be made in the construction, arrangement, operation and method of construction of the two-part collapsible form void disclosed herein without departing from the spirit and scope of the invention as defined in the following claims.

What is claimed is:

1. A two-part collapsible form void for establishing a space in or adjacent to a concrete structure, including:

an outer part comprising, a first sheet of planar material folded over onto itself along a longitudinal fold line and forming first and second portions, wherein said first portion is defined by joined together coextensive strips along two adjacent sides to form a bottom flange, and wherein said second portion is defined by the remainder of the folded first sheet, said second portion having, parallel longitudinal fold lines defining an upper panel, a coextensive base panel, a first side panel and a second side panel, and second strut panels attached to the middle sheet along first and second longitudinal fold lines, said strut panels, in the erected position of the void form, depending downwardly at an angle from the middle sheet, whereby said strut panels extend between the middle sheet and the said parallel longitudinal fold lines which define an intersection between the base panel and the first and second side panels.

2. The combination of claim 1 where the inner part comprises a plurality of contiguous sheets of planer material comprising first and second portions, wherein the first portion of the inner part is defined as the central transverse portion of each of said sheets and a second portion is defined as the remainder of said sheets, and further including, adhesive means joining the said sheets over the first portion thereof.

3. The two-part collapsible void form of claim 2 wherein said plurality of contiguous sheets comprise, a top sheet, having top and bottom surfaces, generally coextensive with said upper panel of said outer part, a second sheet having an elongate central portion adhered to the bottom surface of the central transverse portion of the top sheet, and first the first side of said middle panel, and a second strut panel adjacent the second side of said middle panel;

erecting said outer part by unfolding said panels to form a rectangular parallelogram;

erecting said inner part by unfolding said panels relative to each other to form an articulated inner structure enclosable within said outer part; and slidingly inserting said inner part into said outer part whereby said top panel extends generally between the fold lines defining said upper panel, and said strut panels extend generally to the fold lines defining said base panel.

4. The two-part collapsible form void of claim 3, further comprising an end cap substantially covering an end of said form void between said upper panel, base panel, and side panels.

5. The two-part collapsible form void of claim 4, wherein said end cap is adjoined to said top panel at a fold line and includes a fold-in tab which is insertable into said form void adjacent said base panel.

6. The two-part collapsible form void of claim 4, wherein said end cap is adjoined to said upper panel at a fold line and includes a fold-in tab which is insertable into said form void adjacent said base panel.

7. The two-part collapsible form void of claim 3, wherein said top sheet of the inner part is proximate the said upper panel upon insertion of the inner part into the outer part.

8. The two-part collapsible form void of claim 1, wherein the first sheet of planar material is corrugated paper having parallel corrugation ribs lying in a direction perpendicular to said parallel longitudinal fold lines of said outer part.

9. The two-part collapsible form void of claim 1, wherein said inner part is symmetrical about a vertical elongate central plane.

10. The two-part collapsible form void of claim 3, wherein said inner part further comprises:

a first sheet comprising a top panel generally coextensive with said upper panel;

a second sheet of comprising:

a middle panel joined to the central portion of said top panel;

a first strut panel on one side of said middle panel, said first strut panel folded downwardly to bear against the fold line between said base panel and said first side panel; and a second strut panel on the opposite side of said middle panel, said second strut panel folded downwardly to bear against the fold line between said base panel and said second side panel.

11. The two-part collapsible form void of claim 1, wherein said inner part further comprises:

a first sheet comprising:

a top panel having a transverse center portion and disposed generally coextensive with and underlying said upper panel;

a first side support panel joined to one side of said top panel and configured to be folded downward to a vertical orientation generally coextensive with and adjacent to the first side panel when inserted into said outer part;

a second side support panel joined to an opposite side of said top panel and configured to be folded downward to a vertical orientation generally coextensive with and adjacent to the second side panel when inserted into said outer part;

a second sheet of corrugated paper comprising:

a middle panel having first and second sides and joined to the transverse central portion of said top panel;

a first strut panel adjacent the first side of said middle panel, said first strut panel folded downwardly to bear against the fold line between said base panel and said first side panel; and a second strut panel adjacent the second side of said middle panel, said second strut panel folded downwardly to bear against the fold line between said base panel and said second side panel.

12. The two-part collapsible form void of claim 11, further comprising a third sheet generally coextensive with said second sheet and joined coextensively thereto.

13. The two-part collapsible form void of claim 11, further comprising a third sheet generally coextensive with said second sheet and joined thereto.

14. A two-part collapsible form void for establishing a space in or adjacent to a concrete structure, comprising:

an outer part formed of a first sheet of planar material wherein said first sheet is centrally folded longitudinally and coextensive longitudinal strips along two adjacent sides are joined by adhesive, said joined strips comprising a bottom flange, said first sheet provided with parallel longitudinal fold lines defining an upper panel, a coextensive base panel, a first side panel and a second side panels whereby said first sheet is erected to a rectangular parallelogram cross-section with said bottom flange extending outwardly from and coplanar with the base panel; and an inner part slidably insertable into the erected outer part and formed of a plurality of sheets of planar material, said sheets comprising a plurality of panels formed by joining a transversely central portion of said sheets with adhesive and folding opposing portions of one sheet downwardly along longitudinal parallel fold lines adjacent said joined portion.

15. A method for fabricating a collapsible longitudinal form void from corrugated paper with corrugation ribs lying in a first direction, comprising:

preparing an outer part comprising a first rectangular sheet of corrugated paper having first and second sides perpendicular to the first direction and centrally folded perpendicular to the first direction and being joined by adhesive along a thin strip at the first and second sides of said first sheet;

forming fold lines parallel to said central fold in said first sheet to define an upper panel, opposing side panels on each side of said upper panel, and a base panel joining said side panels;

preparing an inner part comprising:

forming a top panel comprising a second rectangular sheet generally coextensive with said upper panel;

forming fold lines in a third rectangular sheet, having first and second parallel sides, to define a middle panel, a first strut panel adjacent whereby said first sheet is erected to a hollow form having a rectangular parallelogram cross-section with said bottom flange extending outwardly from and coplanar with the base panel, and an inner part slidably insertable into the erected outer part and having, at least one sheet of material having a planar transversely central portion and opposing angularly folded lateral strut panel portions defined by parallel fold lines on either side of the central portion.

16. The method of claim 15, wherein a portion of said inner part is inserted into one outer part, and a remainder of said inner part is inserted into another outer part to form a unitary form void of increased length.

* * * * *